US011248383B2

(12) United States Patent
Stewart et al.

(10) Patent No.: US 11,248,383 B2
(45) Date of Patent: Feb. 15, 2022

(54) INSULATING CONCRETE FORM APPARATUS

(71) Applicants: Cooper E. Stewart, Pelican Rapids, MN (US); Gregory R. Steffes, Beaver Dam, WI (US)

(72) Inventors: Cooper E. Stewart, Pelican Rapids, MN (US); Gregory R. Steffes, Beaver Dam, WI (US)

( * ) Notice: Subject to any disclaimer, the term of this patent is extended or adjusted under 35 U.S.C. 154(b) by 0 days.

(21) Appl. No.: 16/577,841

(22) Filed: Sep. 20, 2019

(65) Prior Publication Data

US 2020/0102761 A1 Apr. 2, 2020

Related U.S. Application Data

(60) Provisional application No. 62/734,713, filed on Sep. 21, 2018.

(51) Int. Cl.
*E04G 17/075* (2006.01)
*E04B 1/16* (2006.01)

(52) U.S. Cl.
CPC ..... *E04G 17/0758* (2013.01); *E04B 1/167* (2013.01)

(58) Field of Classification Search
CPC ..... E04B 1/167; E04B 2/8641; E04B 2002/8694; E04G 17/0758
See application file for complete search history.

(56) References Cited

U.S. PATENT DOCUMENTS

| | | | | |
|---|---|---|---|---|
| 1,924,724 | A * | 8/1933 | Olney | E04B 2/8652 52/379 |
| 3,362,120 | A | 1/1968 | Warren | |
| 3,782,049 | A | 1/1974 | Sachs | |
| 3,922,828 | A | 12/1975 | Patton | |
| 3,979,867 | A | 9/1976 | Sowinski | |
| 4,655,014 | A | 4/1987 | Krecke | |
| 4,730,422 | A * | 3/1988 | Young | E04B 1/86 52/105 |
| 4,860,515 | A | 8/1989 | Browning, Jr. | |
| 4,884,382 | A * | 12/1989 | Horobin | E04B 2/8641 52/426 |
| 5,065,561 | A | 11/1991 | Mason | |
| 5,454,199 | A | 10/1995 | Blom et al. | |
| 5,459,971 | A | 10/1995 | Sparkman | |
| D378,049 | S | 2/1997 | Boeshart | |

(Continued)

FOREIGN PATENT DOCUMENTS

| | | |
|---|---|---|
| AT | 412295 | 12/2004 |
| AT | 414248 | 10/2006 |

(Continued)

*Primary Examiner* — James M Ference
(74) *Attorney, Agent, or Firm* — R. John Bartz

(57) ABSTRACT

An insulating concrete form system uses a stacked arrangement of foam panels to receive pourable concrete to construct a concrete wall of a building structure. Webs located in the panels hold the panels in parallel spaced relation. The webs have laterally extending ties. The ties have one or more projecting members having arms extending into grooves adapted to receive rebar. Outwardly extending truss member are used to fasten multiple webs during shipping. Couplings releasably connect the ties to end portions of the web and allow the ties to be moved along the length of the end portions as desired.

16 Claims, 16 Drawing Sheets

(56) References Cited

U.S. PATENT DOCUMENTS 5,704,180 A * 1/1998 Boeck ..... E04B 2/8652 249/216
6,105,323 A 8/2000 Paulle
D435,212 S 12/2000 Philippe
6,224,031 B1 5/2001 Boeshart
6,230,462 B1 * 5/2001 Beliveau ..... E04B 2/8617 52/426
6,240,692 B1 6/2001 Yost et al.
6,240,693 B1 6/2001 Komasara et al.
6,253,519 B1 7/2001 Daniel
6,253,523 B1 7/2001 McKinnon
6,256,962 B1 7/2001 Boeshart
6,264,035 B1 7/2001 Petrie
6,308,484 B1 10/2001 Severino
6,314,694 B1 * 11/2001 Cooper ..... E04B 2/8611 249/190
6,314,696 B2 11/2001 Fust, III
6,318,040 B1 11/2001 Moore, Jr.
6,321,498 B1 11/2001 Trovato
6,336,301 B1 1/2002 Moore, Jr.
6,378,260 B1 4/2002 Williamson et al.
6,401,413 B1 6/2002 Niemann
6,401,419 B1 * 6/2002 Beliveau ..... E04B 2/8617 52/309.12
6,438,918 B2 8/2002 Moore, Jr. et al.
6,536,172 B1 * 3/2003 Amend ..... E04B 2/8617 249/213
6,568,141 B2 5/2003 Walters
6,668,502 B2 12/2003 Beliveau
6,668,503 B2 12/2003 Beliveau
6,681,539 B2 1/2004 Yost et al.
6,688,066 B1 2/2004 Cottier et al.
6,691,481 B2 2/2004 Schmidt
6,735,914 B2 5/2004 Konopka
6,792,729 B2 * 9/2004 Beliveau ..... E04B 2/8617 52/279
6,820,384 B1 * 11/2004 Pfeiffer ..... E04B 2/8617 52/309.15
6,854,230 B2 2/2005 Starke
6,886,303 B2 2/2005 Schmidt
6,915,613 B2 7/2005 Wostal et al.
6,922,962 B2 8/2005 Schmidt
6,935,079 B1 8/2005 Julian et al.
7,032,357 B2 4/2006 Dunn et al.
7,082,731 B2 8/2006 Cooper et al.
7,082,732 B2 8/2006 Patz et al.
7,284,351 B2 10/2007 Titishov
7,347,029 B2 3/2008 Wostal et al.
7,409,801 B2 8/2008 Pfeiffer
7,415,804 B2 8/2008 Coombs et al.
7,444,789 B1 11/2008 Moore
7,516,589 B2 4/2009 Messiqua et al.
7,565,777 B2 7/2009 Sweeney et al.
7,666,258 B2 2/2010 Guevara et al.
7,699,929 B2 4/2010 Guevara et al.
7,700,024 B1 4/2010 Teng
7,730,688 B2 6/2010 Pfeiffer
7,739,846 B2 6/2010 Garrett
7,757,448 B2 7/2010 Zhu
7,765,765 B1 8/2010 Perronne
7,790,302 B2 9/2010 Ladely (Guevara) et al.
7,805,906 B2 10/2010 Garrett
7,827,752 B2 11/2010 Scherrer
RE41,994 E 12/2010 Mensen
7,861,479 B2 1/2011 Crosby et al.
7,874,112 B2 1/2011 Kovatch et al.
7,964,272 B2 6/2011 Guevara et al.
7,992,359 B2 8/2011 Sill
8,037,652 B2 * 10/2011 Marshall ..... E04B 2/8635 52/309.11
8,048,219 B2 11/2011 Woolsmith et al.
8,074,419 B1 12/2011 Humphress et al.
8,122,653 B2 2/2012 Ellebracht et al.
8,161,699 B2 4/2012 Leblang
8,181,414 B2 5/2012 Garrett
8,276,340 B2 10/2012 Meilleur et al.
8,336,269 B1 12/2012 Mollinger et al.
8,347,581 B2 1/2013 Doerr et al.
8,407,954 B2 4/2013 Keith et al.
8,424,835 B2 4/2013 McDonagh
8,443,560 B2 5/2013 Uhl et al.
8,458,969 B2 6/2013 Richardson et al.
8,468,761 B2 6/2013 Marshall et al.
8,532,815 B1 9/2013 Ciuperca
8,555,581 B2 10/2013 Amend
8,555,582 B2 10/2013 Mollinger et al.
8,555,583 B2 10/2013 Ciuperca
8,555,588 B2 10/2013 Stokes
8,613,174 B2 12/2013 Garrett
8,627,629 B2 1/2014 Tims
8,635,826 B2 1/2014 Pfeiffer
8,646,236 B2 2/2014 Hilliard, Sr.
8,695,299 B2 4/2014 Propst
8,720,160 B1 5/2014 Cooper
8,756,890 B2 6/2014 Ciuperca
8,763,331 B2 7/2014 Leblang
8,782,984 B2 7/2014 Foell et al.
8,800,218 B2 8/2014 Robak
8,800,227 B2 8/2014 Leblang
8,869,479 B2 10/2014 Garrett
8,875,467 B2 11/2014 Anastasi
8,877,329 B2 11/2014 Ciuperca
8,887,465 B2 11/2014 Crosby et al.
8,904,737 B2 12/2014 Schiffmann et al.
8,919,057 B1 12/2014 Dupray
8,919,067 B2 12/2014 Crosby et al.
8,950,137 B2 2/2015 Ciuperca
8,984,827 B2 3/2015 Schreer
8,997,420 B2 4/2015 Amend
9,033,303 B2 5/2015 McDonagh
9,074,379 B2 7/2015 Ciuperca
9,091,089 B2 7/2015 Pfeiffer
9,115,503 B2 8/2015 Ciuperca
9,121,166 B2 9/2015 Amend
9,169,661 B2 10/2015 Spude et al.
9,175,486 B2 11/2015 Pfeiffer
9,234,347 B2 1/2016 Cossette et al.
9,388,561 B2 7/2016 Johnson et al.
9,388,574 B2 7/2016 Ryan
9,422,713 B2 8/2016 Trebil
9,453,345 B2 9/2016 Richardson et al.
9,458,637 B2 10/2016 Ciuperca
9,534,381 B2 1/2017 Hiscock et al.
9,566,742 B2 2/2017 Keating et al.
9,676,166 B1 6/2017 Stachniuk
9,784,005 B2 10/2017 Richardson et al.
10,006,200 B2 6/2018 Baader
2001/0027630 A1 * 10/2001 Moore, Jr. ..... E04B 2/8641 52/741.13
2002/0092253 A1 * 7/2002 Beliveau ..... B29C 44/1271 52/426
2002/0124508 A1 9/2002 Dunn et al.
2002/0162294 A1 * 11/2002 Beliveau ..... E04B 2/8617 52/578
2003/0213198 A1 * 11/2003 Bentley ..... E04B 2/8641 52/415
2004/0040240 A1 3/2004 Patz et al.
2004/0045238 A1 3/2004 Dunn et al.
2004/0103609 A1 * 6/2004 Wostal ..... E04B 2/8617 52/426
2005/0028466 A1 * 2/2005 Titishov ..... E04B 2/8617 52/474
2005/0028467 A1 * 2/2005 Bentley ..... E04B 2/8641 52/474
2005/0223669 A1 * 10/2005 Cymbala ..... E04C 1/41 52/426
2006/0117690 A1 * 6/2006 Garrett ..... E04B 2/8647 52/309.11
2006/0117693 A1 6/2006 Garrett
2006/0124825 A1 6/2006 Amend
2006/0151677 A1 * 7/2006 McIvor ..... E04B 2/8617 249/36

(56) References Cited

U.S. PATENT DOCUMENTS

| | | | | |
|---|---|---|---|---|
| 2007/0294970 | A1* | 12/2007 | Marshall | E02D 27/02 52/309.11 |
| 2008/0022619 | A1 | 1/2008 | Scherrer | |
| 2008/0028709 | A1* | 2/2008 | Pontarolo | E04B 2/8647 52/426 |
| 2009/0013629 | A1 | 1/2009 | Boeshart | |
| 2011/0011022 | A1 | 1/2011 | Garrett | |
| 2011/0131911 | A1 | 6/2011 | McDonagh | |
| 2011/0265414 | A1* | 11/2011 | Ciccarelli | E04B 2/8635 52/426 |
| 2014/0259990 | A1 | 9/2014 | Pfeiffer | |
| 2014/0260055 | A1* | 9/2014 | Pfeiffer | E04G 17/12 52/582.1 |
| 2016/0215511 | A1* | 7/2016 | Salekarr | E04G 19/003 |
| 2016/0281361 | A1 | 9/2016 | Baader | |
| 2016/0340899 | A1* | 11/2016 | Piccone | E04B 2/86 |
| 2017/0009449 | A1 | 1/2017 | Leen | |
| 2017/0058591 | A1* | 3/2017 | Garrett | E04B 2/86 |
| 2017/0218642 | A1 | 8/2017 | Jensen | |
| 2017/0254072 | A1* | 9/2017 | Howorth | B28B 7/306 |
| 2017/0321419 | A1* | 11/2017 | Stewart | E04B 2/8635 |
| 2020/0102761 | A1* | 4/2020 | Stewart | E04B 2/8641 |

FOREIGN PATENT DOCUMENTS

| | | |
|---|---|---|
| AT | 504754 | 8/2008 |
| AT | 513020 | 12/2013 |
| AT | 514300 | 11/2014 |
| AT | 516119 | 5/2016 |
| AT | 518959 | 2/2018 |
| CA | 2094322 | 10/1994 |
| CA | 2292865 | 6/2000 |
| CA | 2291331 | 5/2001 |
| CA | 2353305 | 8/2002 |
| CA | 2412130 | 5/2003 |
| CA | 2512211 | 7/2004 |
| CA | 2524411 | 5/2006 |
| CA | 2818412 | 5/2011 |
| CA | 2812445 | 1/2014 |
| CA | 2953386 | 1/2016 |
| CN | 2863962 | 1/2007 |
| CN | 103806538 | 5/2014 |
| CN | 103821264 | 5/2014 |
| DE | 19548440 | 4/1997 |
| DE | 10047283 | 12/2001 |
| DE | 10007067 | 11/2002 |
| DE | 10110798 | 9/2003 |
| DE | 10310401 | 7/2004 |
| DE | 102005006499 | 1/2008 |
| DE | 102005025037 | 2/2009 |
| DE | 102006021781 | 6/2010 |
| DE | 19946320 | 8/2012 |
| DE | 102011119454 | 10/2016 |
| DE | 102007005119 | 1/2017 |
| EP | 0374064 | 6/1990 |
| EP | 1482098 | 12/2004 |
| EP | 1690993 | 8/2006 |
| EP | 1712696 | 10/2006 |
| EP | 1793056 | 6/2007 |
| EP | 1953303 | 8/2008 |
| EP | 1956156 | 8/2008 |
| EP | 2058446 | 5/2009 |
| EP | 2060704 | 5/2009 |
| EP | 2123837 | 11/2009 |
| EP | 2169135 | 3/2010 |
| EP | 2267235 | 12/2010 |
| EP | 2410100 | 1/2012 |
| EP | 2439352 | 4/2012 |
| EP | 2495375 | 9/2012 |
| EP | 2500479 | 9/2012 |
| EP | 2535463 | 12/2012 |
| EP | 2610412 | 7/2013 |
| EP | 2873781 | 5/2015 |
| EP | 2944735 | 11/2015 |
| EP | 2987921 | 2/2016 |
| EP | 3078784 | 10/2016 |
| ES | 2235583 | 7/2005 |
| ES | 2246667 | 2/2006 |
| ES | 2276552 | 6/2007 |
| FR | 2845408 | 4/2004 |
| FR | 2877025 | 4/2006 |
| FR | 2885625 | 11/2006 |
| FR | 2910916 | 7/2008 |
| FR | 2918399 | 1/2009 |
| FR | 2927105 | 8/2009 |
| FR | 2930959 | 11/2009 |
| FR | 2942824 | 9/2010 |
| FR | 2948139 | 1/2011 |
| FR | 2949131 | 2/2011 |
| FR | 2970490 | 7/2012 |
| FR | 2971803 | 8/2012 |
| FR | 2972208 | 9/2012 |
| FR | 2974588 | 11/2012 |
| FR | 2993290 | 1/2014 |
| FR | 3004200 | 10/2014 |
| FR | 3008115 | 1/2015 |
| GB | 2397589 | 7/2004 |
| GB | 2400617 | 10/2004 |
| GB | 2402141 | 12/2004 |
| GB | 2445943 | 7/2008 |
| GB | 2458317 | 9/2009 |
| GB | 2512882 | 10/2014 |
| GB | 2531912 | 5/2016 |
| IT | 102010901855659 | 10/2010 |
| IT | 102010901810994 | 8/2011 |
| IT | 102010901821713 | 9/2011 |
| JP | 2004521210 | 7/2004 |
| JP | 3721649 | 11/2005 |
| JP | 3957108 | 8/2007 |
| KR | 200179051 | 4/2000 |
| KR | 200193218 | 8/2000 |
| KR | 200196811 | 9/2000 |
| KR | 200203651 | 11/2000 |
| KR | 200315449 | 6/2003 |
| KR | 200322018 | 7/2003 |
| KR | 200322036 | 7/2003 |
| KR | 200334215 | 11/2003 |
| KR | 200353777 | 6/2004 |
| KR | 200353778 | 6/2004 |
| KR | 200353779 | 6/2004 |
| KR | 200383306 | 5/2005 |
| KR | 200390892 | 7/2005 |
| KR | 200397218 | 9/2005 |
| KR | 200424436 | 8/2006 |
| KR | 200425791 | 9/2006 |
| KR | 200427139 | 9/2006 |
| KR | 100732603 | 6/2007 |
| KR | 101302520 | 9/2013 |
| KR | 101523987 | 6/2015 |
| KR | 101553345 | 9/2015 |
| KR | 101698548 | 1/2017 |
| KR | 101708760 | 2/2017 |
| KR | 101795986 | 11/2017 |
| KR | 101835094 | 3/2018 |
| KR | 101835378 | 3/2018 |
| KR | 101842239 | 3/2018 |
| KR | 101855472 | 6/2018 |
| KR | 101880813 | 7/2018 |
| NL | 1041172 | 8/2015 |
| RU | 2492299 | 9/2013 |
| RU | 2608374 | 1/2017 |
| WO | WO-00/58577 | 8/2000 |
| WO | WO-01/59227 | 8/2001 |
| WO | WO-2006/091864 | 8/2006 |
| WO | WO-2006091864 | 8/2006 |
| WO | WO-2009/049336 | 4/2009 |
| WO | WO-2009/124526 | 10/2009 |
| WO | WO-2011/039627 | 4/2011 |
| WO | WO-2011/101768 | 8/2011 |
| WO | WO-2012/016268 | 2/2012 |

(56) References Cited

FOREIGN PATENT DOCUMENTS

| | | |
|---|---|---|
| WO | WO-2014/158304 | 10/2014 |
| WO | WO-2016/037864 | 3/2016 |
| WO | WO-2017/126951 | 7/2017 |

* cited by examiner

INSULATING CONCRETE FORM APPARATUS

CROSS REFERENCE TO RELATED APPLICATION

This application claims the priority of U.S. Application Ser. No. 62/734,713 filed Sep. 21, 2018.

FIELD OF THE INVENTION

The technology of the invention relates to insulating concrete form systems used in construction of poured concrete walls in building structures.

BACKGROUND OF THE INVENTION

Traditionally construction and fabrication of poured concrete walls have used insulating concrete form systems utilizing a stacked arrangement of foam panels to form a preferred shape of an interior cavity for receiving pourable concrete. The panels may be made from rigid foam insulation, or any other material used to insulate a building and capable of maintaining a form for concrete pouring. The panels are reversible, modular, and may be stacked in an offset manner to form any height wall. Traditional construction methods often attempt to form a similar finished wall product using fewer points of connectivity resulting in substantial difficulty during the construction process. Each individual panel in traditional methods did not attempt to connect to adjoining units with enough structure to withstand the pressures of shipping, pouring of the concrete, wear over time. In other prior art, individual units required too much force to disassemble where a section of the wall required revision. There is a need for an insulated concrete form which provides enough structure to withstand shipping and assembly while allowing for easy disassembly and correction of mistakes during construction.

Sparkman in U.S. Pat. No. 5,459,971 shows an insulating concrete form system having a pair of foam panels connected together with a connector. The connector has a pair of elongated anchor members each embedded longitudinally inside a corresponding foam panel. Sparkman employs a substantially dissimilar cavity for accommodating concrete which results in heavier and thicker final walls.

Philippe in U.S. Pat. No. 5,438,933 shows an insulating construction form having panels with top and bottom surfaces and interconnecting members comprising alternating protrusions and recesses on the top and bottom surfaces. Philippe does not allow for any variation to the size and placement of the ties along the length of the wall, and is therefore not able to accommodate differing pressures during the concrete pouring process.

Cymbala et al in U.S. Pat. No. 5,896,714 shows an insulating concrete form system having a pair or parallel foam panels spaced using a plurality of plastic ties. Each tie has two laterally opposed supports connected together with a web. The ties and panels are formed in a molded-in configuration. Cymbala et al does not contemplate structure to overcome the forces present during shipping or handling which may warp or otherwise damage the web material prior to final assembly at the construction site.

SUMMARY OF THE INVENTION

The insulating concrete form apparatus has a pair of panels with at least one web extending between the panels. Each panel is located in spaced relationship relative to each other. The panels each have a top surface and a bottom surface. First protrusions form a part of the top surface. Second protrusions form a part of the bottom surface. The first protrusions are aligned with the second protrusions such that the panels can be stacked either above or below additional pairs of panels. The first protrusions are in symmetry with the second protrusions. The web has an end portion. The end portion extends vertically along one of the panel. The end portion has an inner support and an outer support located in spaced relationship with the inner support. The end portion has a truss member extending between the inner support and the outer support. The web has one or more ties extending to the end portion. The tie is releasably connected to the end portion whereby the tie can be connected to the one end portion at any point on the end portion. The tie has a coupling having one or more pins releasably connecting the tie to the end portion and allowing the coupling to be moved vertically relative to the end portion. The coupling has a channel to allow said the tie to remain in lateral position relative to the end portion while the pin is being moved vertically relative to said the end portion.

DESCRIPTION OF THE INVENTION

Figure 1:
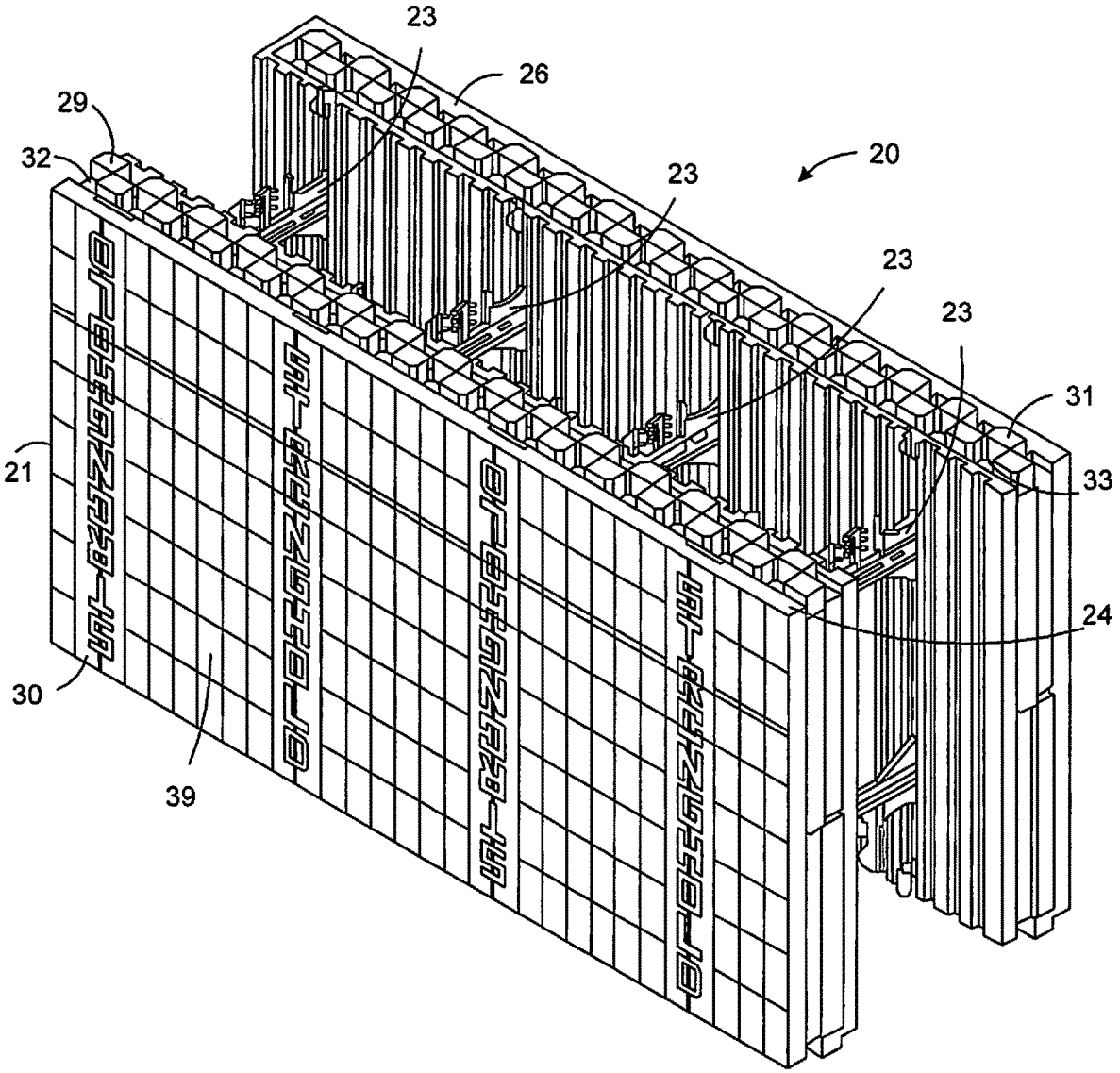
FIG. 1 is a perspective view of the insulating concrete form of the invention.
Figure 2:
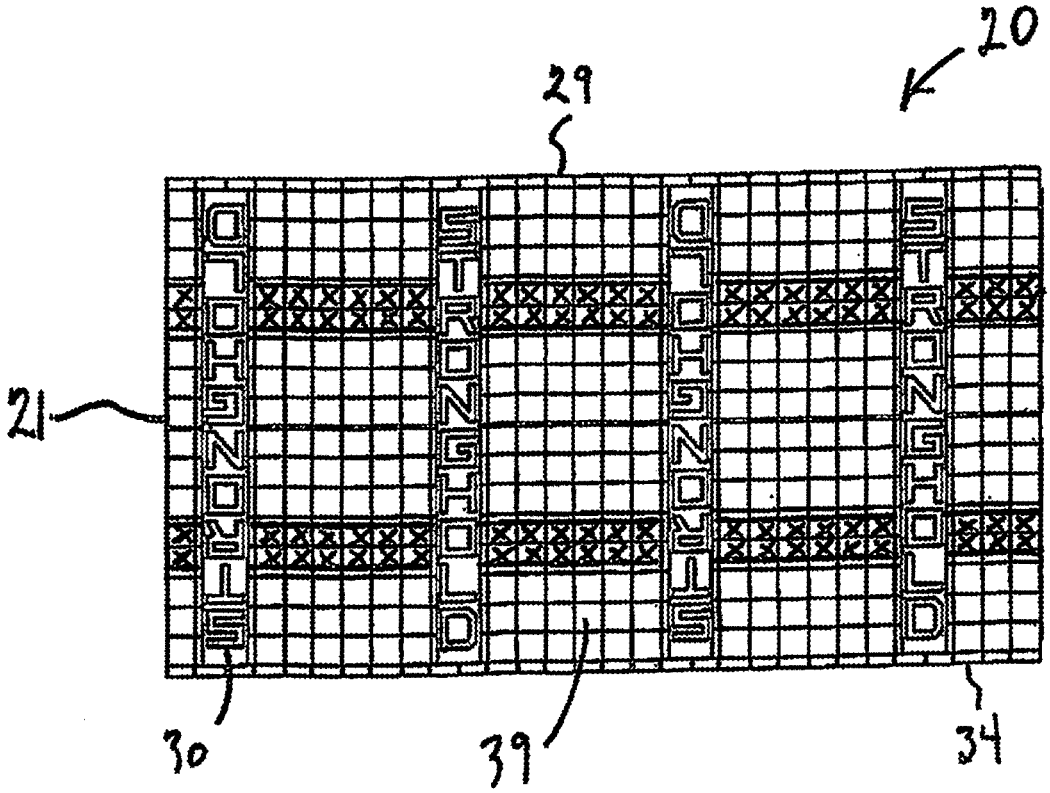
FIG. 2 is an elevated side view of the insulating concrete form of FIG. 1.
Figure 3:
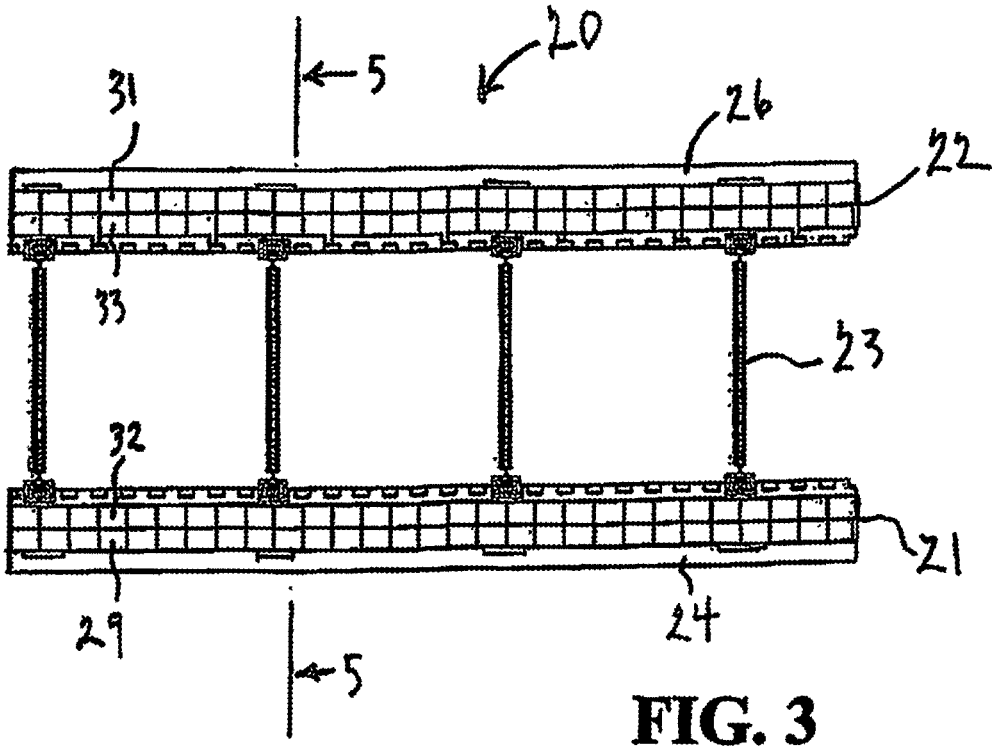
FIG. 3 is a top plan view of the insulating concrete form of FIG. 1.
Figure 4:
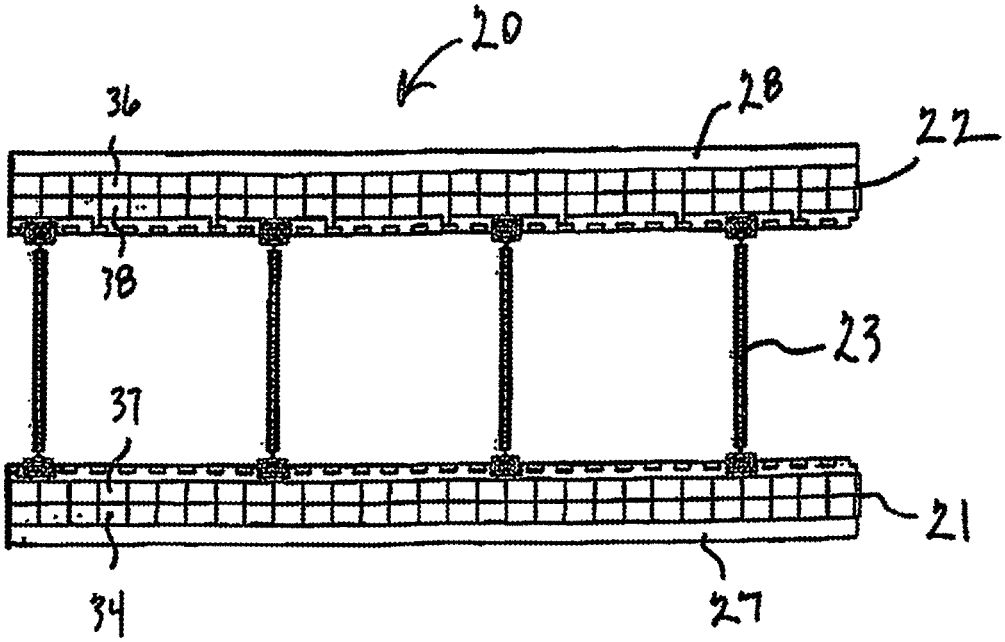
FIG. 4 is a bottom plan view of the insulating concrete form of FIG. 1.

The following description and drawing of the insulating concrete form apparatus are embodiments in which the invention may be used. Other embodiments of insulating concrete forms including structural changes can be made without departing from the invention. As shown in FIGS. 1 to 5, a first embodiment of an insulating concrete form, indicated generally at 20, has a pair of panels 21 and 22 configured to receive pourable concrete to create a concrete wall in a building structure. A plurality of webs 23 extend between foam panels 21 and 22 to connect and hold panels 21 and 22 in parallel spaced relation. The panels may be set at any variable width relative to each other in order to create different desirable width walls. Webs 23 are semi-rigid molded plastic members. Webs 23 may be of any variable height or length to accommodate differing width or height walls. Panel 21 may sit at any variable distance from corresponding panel 22 to form curving walls, corner walls, walls of tapering or increasing thickness, or any desired variation of concrete wall. Other materials and methods can be used to make webs 23 or foam panels 21 and 22.

Panels 21 and 22 have top surfaces 24 and 26 and bottom surfaces 27 and 28 opposite from top surfaces 24 and 26. Top surfaces 24 and 26 have a plurality of protrusions 29 and 31 which are aligned and in mirror symmetry to protrusions disposed on corresponding stacked upper and lower panels. Bottom surfaces 27 and 28 have a plurality of alternating protrusions 34 and 36 and intervals 37 and 38. Intervals 32 and 33 are formed between protrusions 29 and 31 and are positioned to accommodate protrusions from panels stacked either above or below panels 21 and 22. Protrusions 29, 31, 34 and 36 and intervals 32, 33, 37 and 38 are similarly sized and complementary in shape configured to cooperate with adjoining protrusions and intervals along opposite top and bottom surfaces 24, 26, 27 and 28 allowing insulating concrete form 20 to be reversible in use. Top surfaces 24 and 26 are in mirror symmetry with bottom surfaces 27 and 28 such that each individual foam panel may be inverted and still fit in cooperation with adjacent foam panels.

In a first embodiment, web 23 has ties 42 and 43 extending between and connected to end portions 44 and 46 of web 23. End portions 44 and 46 extend substantially the entire height of panel 21 such that each end portion 44 and 46 connect and support corresponding end portions from panels stacked above and below panel 21. Tie 42 has one or more projecting members 49 to 54, 70 and 71, and tie 43 has one or more projecting members 10 to 17, adapted to receive and secure one or more reinforcing bars to strengthen and reinforce the concrete. Projecting members 49 to 54, 70 and 71 project toward the top of web 23, and projecting members 10 to 17 project towards the bottom of web 23 allowing web 23 to be reversible. In the preferred embodiment, the reinforcing bar may be one or more cylindrical steel rebar which extend laterally across the length of the wall and attach to multiple webs, including web 23, via projecting members to reinforce the concrete.

In the preferred embodiment, projecting members 49 to 54, 70 and 71 of tie 42 and projecting members 10 to 17 of tie 43 are in alignment with projecting members of additional ties in panel 21 and panel 22 such that a cylindrical reinforcing bar may be attached to each tie along the wall without bending or other interruption. Where a curving wall or corner is desired, each tie may sit in proportional alignment to allow reinforcing bar to follow the shape of the wall.

Figure 6:
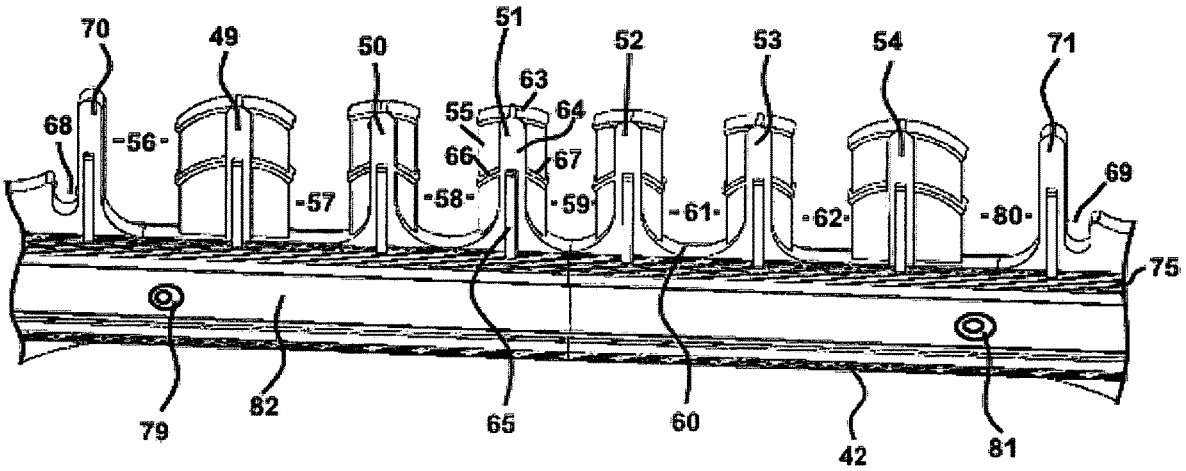
FIG. 6 is an enlarged foreshortened front elevational view of a tie of the insulating concrete form of FIG. 1.

Referring to FIG. 6, tie 42 has a plurality of laterally spaced projecting members 49, 50, 51, 52, 53 and 54 that extend upwardly from the top 75 of tie 42 to define grooves 56, 57, 58, 59, 61, 62 and 80 for receiving and holding reinforcing bar. The lateral spacing of projecting members 49 to 54 is varied whereby grooves 56, 57, 58, 59, 61, 62 and 80 have varying widths to accommodate different sized reinforcing bar. Each groove 56, 57, 58, 59, 61, 62, and 80 has a bottom 60 to allow reinforcing bar to rest in grooves 56, 57, 58, 61, 62 and 80. Grooves 56, 57, 58, 61, 62 and 80 and bottom 60 may be of any desired width, height, or size such that they may allow reinforcing bar to be held in place and rest in a groove. Projecting members 49 to 54 have a uniform height. Projecting members 70, 71 may be slightly taller than projecting members 49 to 54 to allow easier application of reinforcing bar. The heights of projecting members 49 to 54, 70, 71 can be made to vary as desired.

Projecting members 49 to 54 each have a body 55, a base 65 and a head member 63 joined to a centrally located rib member 64. Rib member 64 extends downwardly from head member 63 to top 75 of tie 42. The outer ends of head member 63 extend towards adjacent grooves 56, 57, 58, 59, 61, 62 and 80. Head members 66 and 67 are located substantially centrally on and joined to rib member 64 where they curve downwardly away from rib member 64 in order to bias head member 66 and 67 against upward forces acting on reinforcing bar. The outer ends of head members 66 and 67 extend towards adjacent grooves 56, 57, 58, 59, 61, 62 and 80 inwardly from the outer ends of head member 63. The side walls of body 55 are adapted to change in shape and deform upon application of force such as when reinforcing bar is placed into grooves 56, 57, 58, 59, 61, 62 and 80. The outer ends of head member 63 and head members 66 and 67 and the deformation of the side walls of body 55 of projecting members 49 to 54 prevent the reinforcing bar from moving upward and out of grooves 56, 57, 58, 59, 61, 62 and 80. Projecting members 70 and 71 consist of only rib members 64. In an alternative embodiment, projecting members 49 to 54 have a head member 63 attached to a rib member 64 and a body 55 with no additional head members. Body 55 deforms when reinforcing bar is placed in a corresponding groove such that body 55 takes on the shape and applies pressure to the reinforcing bar. In an additional alternative embodiment, projecting members 49 to 54 have a head member 63 and a rib member 64 with additional head members or body. In an additional alternative embodiment, head member 63 may project laterally from a rib member 64 towards one adjacent groove on tie 42.

Tie 43 may have projecting members 10 to 17 in vertical alignment with projecting members 49 to 54 of tie 42 such that web 23 is reversible. The projecting members 10 to 17 of tie 43 are laterally spaced and project downwardly from a bottom of tie 43 to define grooves substantially similar to grooves 56, 57, 58, 59, 61, 62 and 80 for receiving and holding reinforcing bar. Where web 23 is reversed, the projecting members 10 to 17 of tie 43 project upwardly from top of tie 43 to define grooves substantially similar to grooves 56, 57, 58, 59, 61, 62 and 80 for receiving and holding reinforcing bar.

Top 75 of tie 42 has depressions 68 and 69 for accommodating reinforcing cords used in construction. In the preferred embodiment, depressions 68 and 69 are located adjacent upright projecting members 70 and 71. Projecting members 70 and 71 may facilitate placement of reinforcing cords in depressions 68 and 69. Depressions 68 and 69 are in alignment with adjacent webs in panel 21 and 22 such that reinforcing cords may extend laterally the length of the wall without curvature or interruption. Reinforcing cords may be made of any flexible material such that they cooperate and are held in place by depressions 68 and 69. In the preferred embodiment, reinforcing cords are placed before the addition of reinforcing bar to provide stability to webs to accommodate the placement of reinforcing bar.

Figure 5:
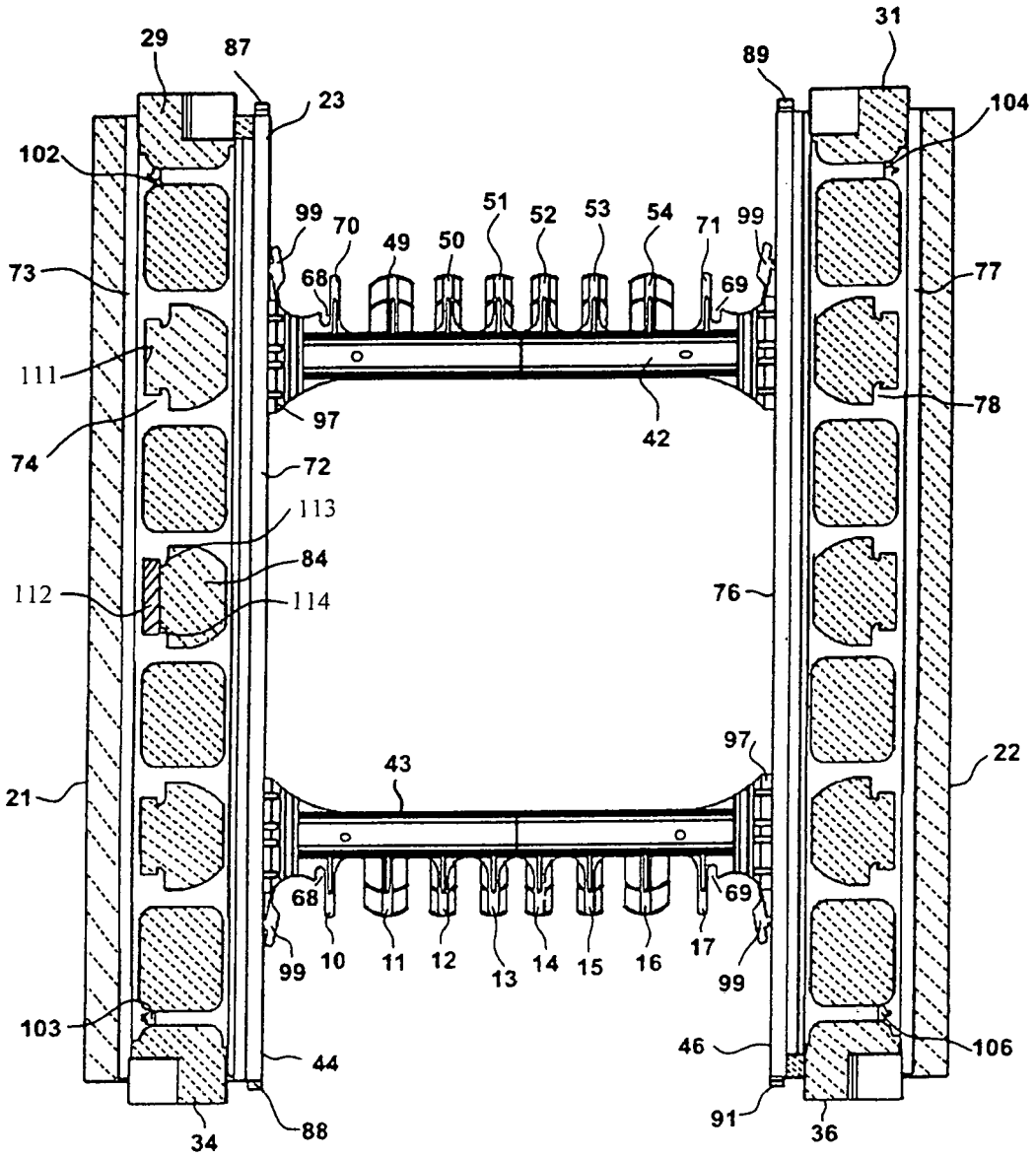
FIG. 5 is an enlarged sectional view taken along line 5-5 of FIG. 3.

End portion 44 has an inner support 72 and an outer support 72 laterally spaced from and extending parallel to inner support 72, as seen in FIG. 5. Inner support 72 and outer support 73 are joined to a truss member 74 that extends between inner support 72 and outer support 73. Truss member 74 may also extend through inner support 72 to connect and support face 90 of inner connector 95. The portion of truss member 74 extending past inner support 72 is labeled truss member portion 109. Truss member 74 and outer support 73 of end portion 44 are located within foam panel 21. Similarly, end portion 46 has an inner support 76 joined to an outer support 77 via truss member 78 extending between inner support 76 and outer support 77. Truss member 78 and outer support 77 of end portion 46 are located within panel 22. Ties 42 and 43 extend between, and are movably mounted on, inner support 72 and corresponding outer support 76 of end portions 44 and 46. Truss member 74 may alternatively consist of several separate truss members oriented between outer support 77 and through inner support 76 to face 90.

Tie 42 has tab members 79 and 81 extending outwardly from tie 42 and oriented to separate tie 42 from adjacent ties during shipping. In the preferred embodiment, tab members 79 and 81 are cylindrical shaped members that extend sideways from side 82 of tie 42. Side 82 may have a corresponding bore located opposite tab members 79 and 81 to receive tab members 79 and 81. Tab members 79 and 81 function to preserve the shape of ties, prevent movement relative to one another, separate individual ties, or prevent warping of ties during shipping. Tab members 79 and 81 and their corresponding bores can be made to have other shapes. Tab members 79 and 81 may be of sufficient height to prevent tie 42 from coming in contact with adjacent stacked ties during shipping.

Indicia 30 located on exterior face 39 of panel 21 are in alignment with webs 23 such that indicia 30 indicate the relative position and size of outer support 73 of web 23. Indicia 30 are similar in shape and orientation to the outer face of end portion 44 in order to allow an observer to quickly and easily locate webs 23 for manipulation of the entire structure. In this embodiment indicia 30 are rectangular in shape and are located at spaced intervals corresponding to the location of each individual web.

Truss members 74 and 78 have a plurality of longitudinal rectangular shaped access slots 111 adapted to accommodate a strip member 112 to laterally reinforce insulating concrete form 20. Prong members 113 and 114 extend into and form access slot 111 and retain strip member 112 in slot 111. Strip member 112 is placed through opening 84 adjacent access slot 111 and then moved over prong members 113 and 114 into slot 111. Strip members 112 have grooves 86 that align with prong members 113 and 114 to allow strip member 112 to be moved into slot 111 with a friction fit to laterally reinforce insulating concrete form 20 and prevent separation of panels due to hydrostatic pressure during a concrete pour. Strip member 112 may extend between multiple ties, and may extend around corners to laterally reinforce multiple ties in insulated concrete form 20.

Figure 9:
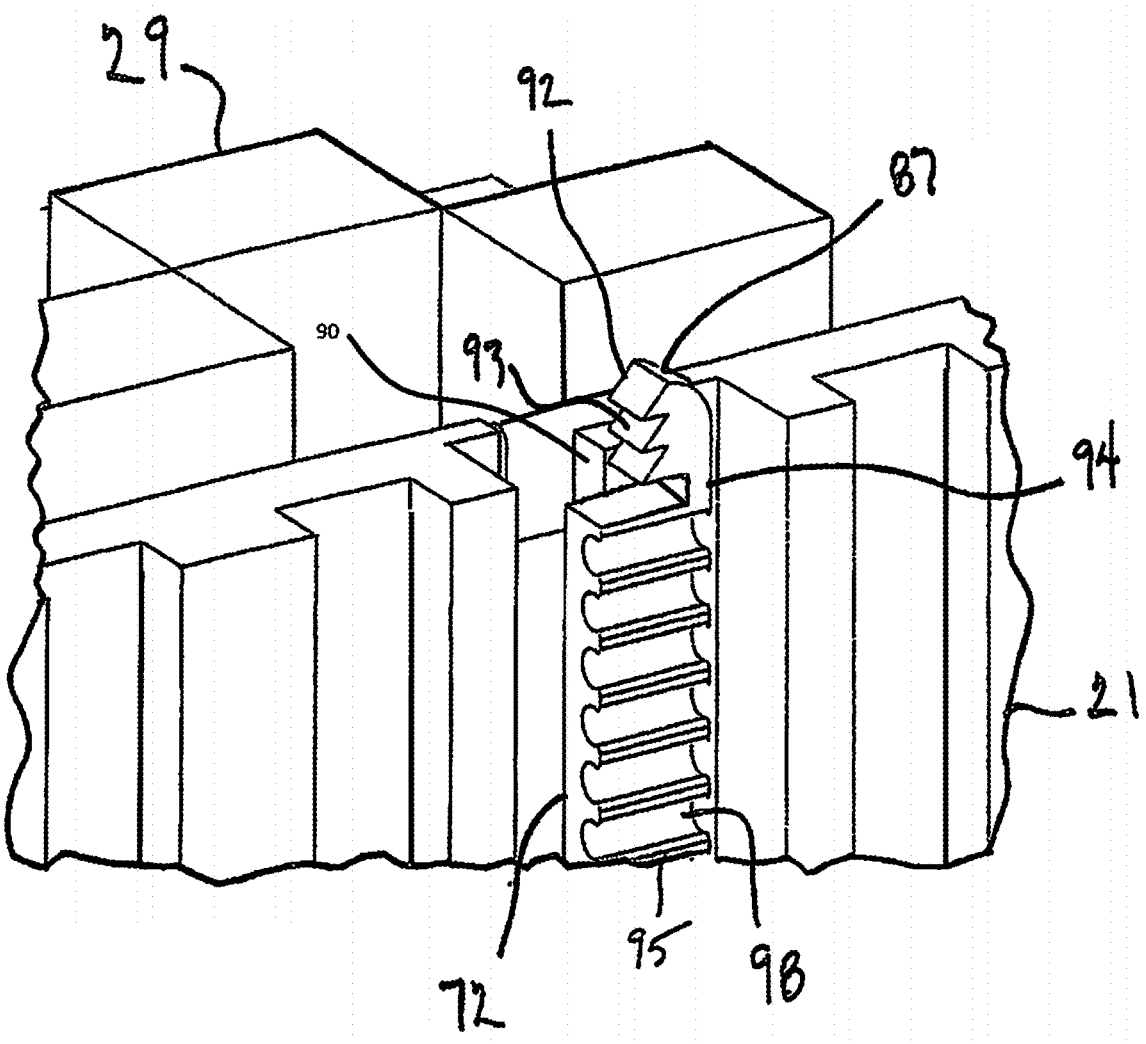
FIG. 9 is an enlarged foreshortened perspective view of a fastener for interlocking insulating concrete forms of FIG. 1 in stacked relation.

The outer ends of inner supports 72 and 76 have vertical fasteners 87, 88, 89 and 91 to connect end portions 44 and 46 of web 23 to adjacent end portions of webs of another insulating concrete form stacked on top of insulating concrete form 20 during wall construction. Vertical fasteners 87, 88, 89 and 91 have side portions 92 having teeth 93 for interlocking with the teeth of vertical fasteners of adjacent webs of another insulating concrete form when stacked on insulating concrete form 20. Each vertical fastener 87, 88, 89 and 91 has a lower weak portion 94 located adjacent the outer ends of inner supports 72 and 76, as seen in FIG. 9. Vertical fasteners 87, 88, 89 and 91 are adapted to bend or fracture at weak portion 94 to allow interlocked insulating concrete forms to be easily separated as vertical fasteners 87, 88, 89 and 91 can be disengaged with a reduced force.

Teeth 93 of vertical fasteners 87 and 88 extend in opposite lateral directions on the outer ends of inner support 72 of end portion 44. Teeth 93 of vertical fasteners 89 and 91 extend in opposite lateral directions on the outer ends of inner support 76 of end portion 46. Teeth 93 of vertical fasteners 88 and 89 extend in a lateral direction opposite from teeth 93 of fasteners 87 and 91 whereby insulating concrete form 20 is reversible and can be stacked in either orientation during construction.

Figure 7:
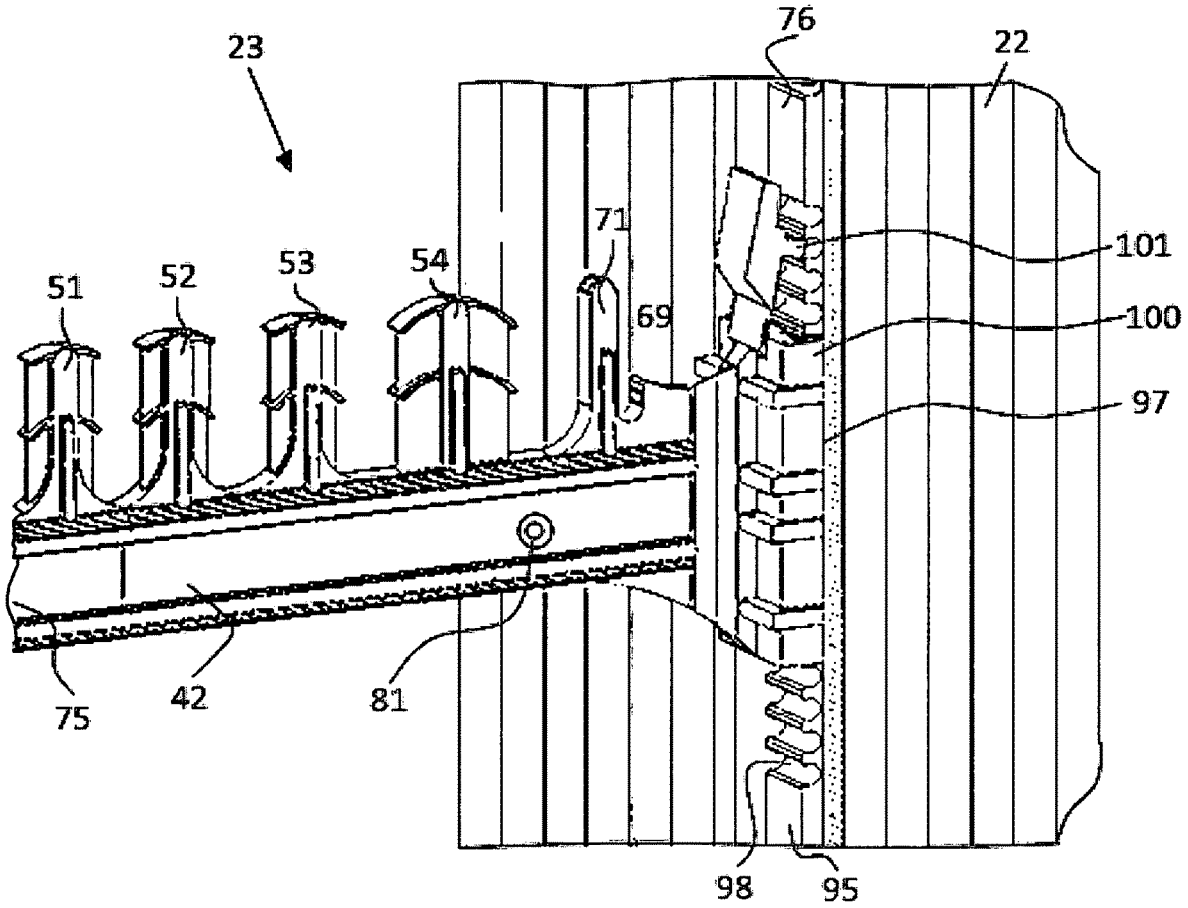
FIG. 7 is an enlarged foreshortened perspective view of a connector assembly movably mounting a tie to an end portion of a web located in a foam panel of the insulating concrete form of FIG. 1.
Figure 8:
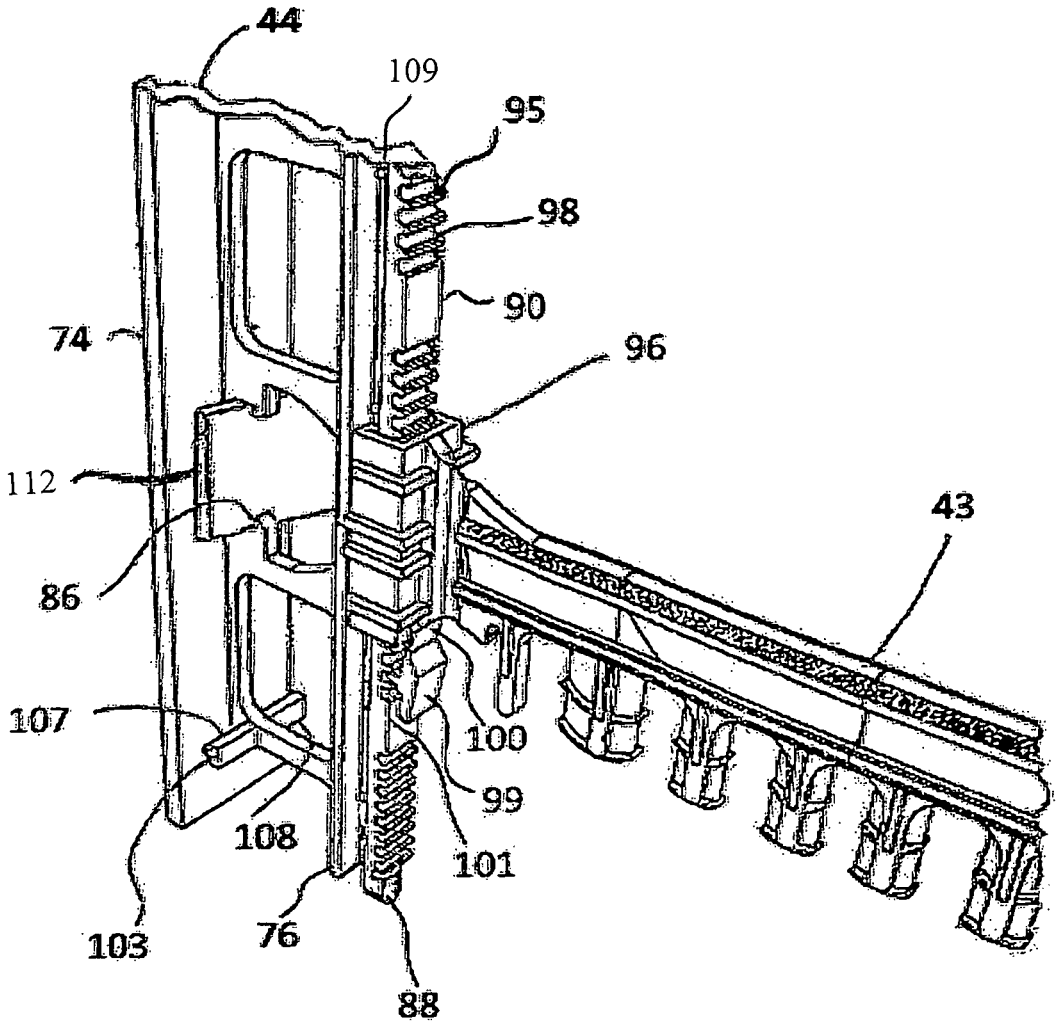
FIG. 8 is an enlarged foreshortened perspective view of a lower portion of a web of the insulating concrete form of FIG. 1.

Referring to FIGS. 7 and 8, the outer ends of ties 42 and 43 have tie connectors 96 adapted to connect ties 42 and 43 to end portions 44 and 46 of web 23. Tie connector 96 has a channel shaped body 97 adapted to extend over and around inner connector 95 of inner supports 72 and 76 of end portions 44 and 46. Inner connector 95 has a face 90 attached to inner support 72 by truss member portion 109 such that body 97 may cooperate and wrap around face 90. Truss member portion 109 is of sufficient length to allow body 97 free vertical movement relative to inner support 72. Body 97 is movable along the length of inner connector 95 of inner supports 72 and 76 to adjust in infinite increments the vertical positions of ties 42 and 43 within insulating concrete form 20 from a vertical position adjacent the top of insulating concrete form 20 to a vertical position adjacent the bottom of form 20, as needed. Ties 42 and 43 can be moved to positions within insulating concrete form 20 to allow additional ties to be connected to end portions 44 and 46 and located in form 20, if desired. Ties 42 and 43 may be slid down past insulated concrete form 20 to connect to adjacent insulated concrete forms either above or below insulated concrete form 20. Vertical fasteners 87, 88, 90, 91 create an uninterrupted continuous structure of cooperating face 90, and vertically adjacent faces, to allow for continuous movement of ties 42 and 43 to further insulated concrete forms.

Inner connectors 95 on inner supports 72 and 76 have a series of vertically spaced indentations 98. Indentations 98 have an inwardly curving shape. Indentations 98 can be made to have a rectangular channel shape or other shapes. A catch member 99 attached to body 97 has an extended portion 101 adapted to extend into a selected indentation 98 of inner connector 95 to maintain the vertical positions of ties 42 and 43 and lock ties 42 and 43 into measured increments within insulating concrete form 20. Extended portion 101 has a complimentary shape to and a friction fit with indentations 98. Catch member 99 has a resilient base portion 100 adapted to bias extended portion 101 into indentation 98. Catch member 99 is moved outwardly away from inner connector 95 to move extended portion 101 out of indentation 98 to release catch member 99. Catch member 99 can be made to have a flexible portion, or hinge, to allow catch member 99 to be released.

End portions 42 and 46 have fasteners 102, 103, 104 and 106 extending outwardly from truss members 74 and 78 for securing a plurality of webs during shipping. Fasteners 102, 103, 104 and 106 have a pair of bar members 107 and 108 projecting outwardly from opposite sides of the lower and upper ends of truss members 74 and 78. Bar members 107 and 108 are laterally spaced from outer supports 73 and 77 of end portions 42 and 46 to accommodate the outer edge portion of the outer support of another web whereby the outer edge portion of the outer support of an adjacent web can be inserted and held between bar members 107 and 108 and outer supports 73 and 77 of web 23 to secure the adjacent web to web 23.

Figure 10:
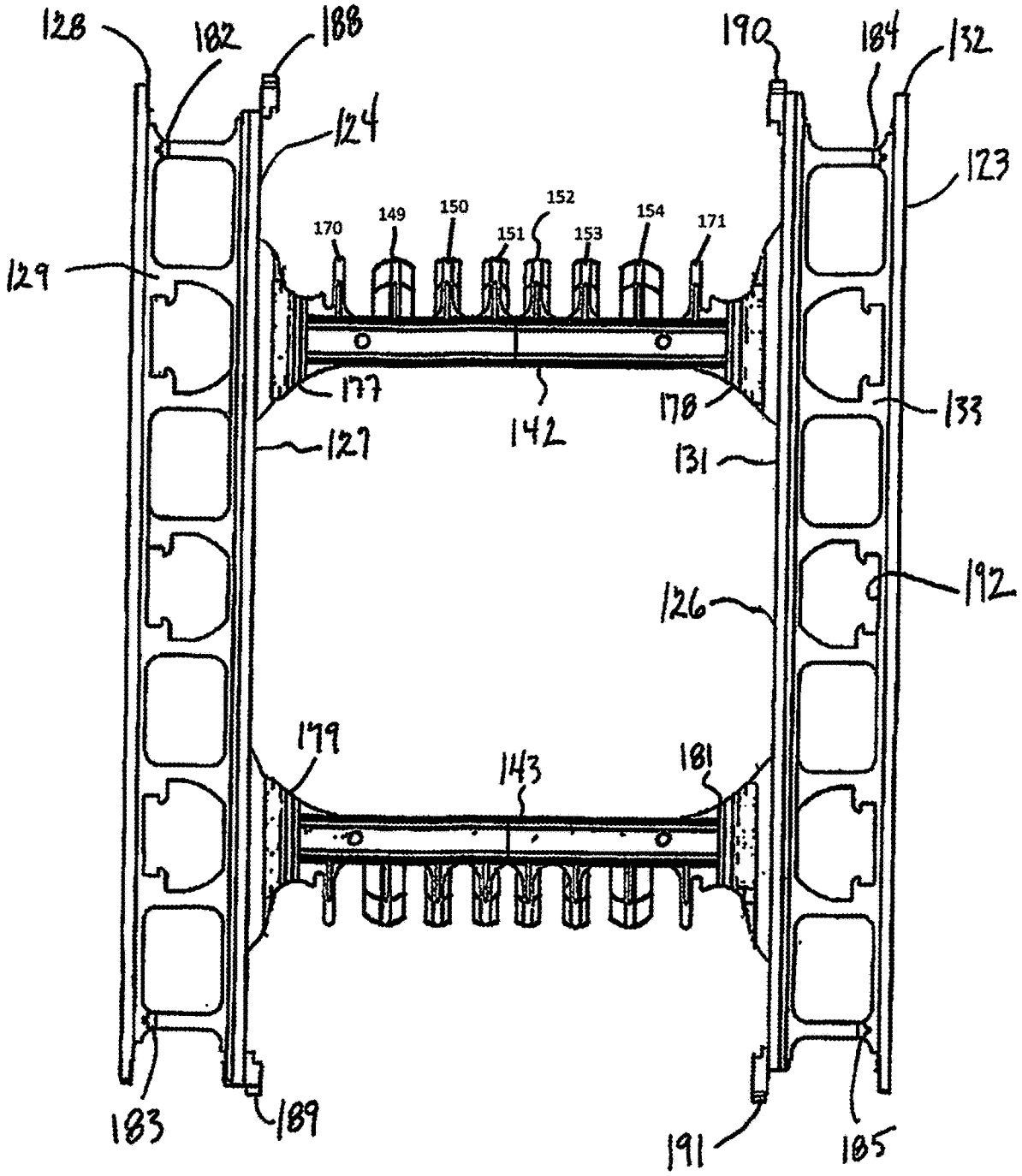
FIG. 10 is a front elevational view of a first modification of the web of the insulating concrete form of FIG. 1.
Figure 11:
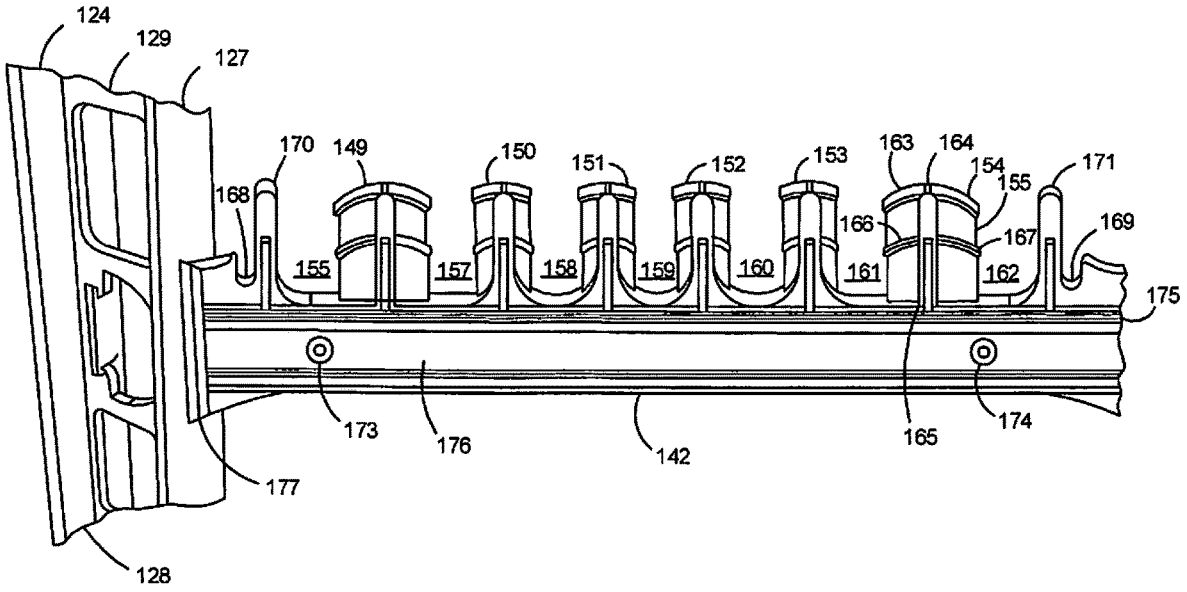
FIG. 11 is an enlarged foreshortened perspective view of the web of FIG. 10.
Figure 12:
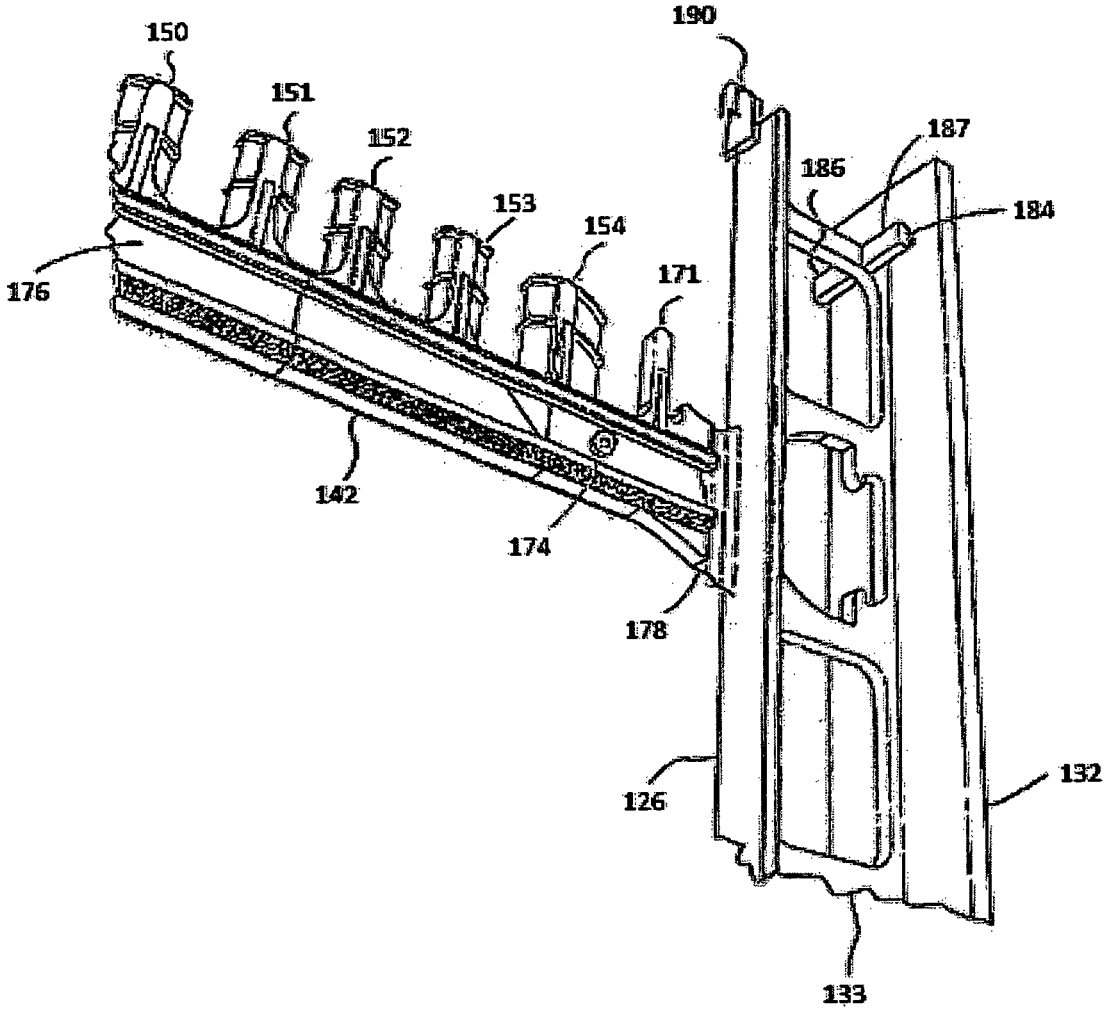
FIG. 12 is an enlarged foreshortened perspective view of an upper portion of the web of FIG. 10.

Referring to FIGS. 10 to 12, a first modification of a web 123 used to connect and hold panels 21 and 22 of insulating concrete form 20 in parallel spaced relation configured to receive pourable concrete to create a concrete wall in a building structure is shown. Web 123 has a pair of ties 142 and 143 extending between end portions 124 and 126. Ties 142 and 143 have one or more laterally spaced projecting members 149, 150, 151, 152, 153 and 154 defining grooves 156, 157, 158, 159, 160, 161 and 162 adapted to receive and secure reinforcing bar to strengthen and hold concrete located in insulating concrete foam 20 in compression.

Each projecting member 149 to 154 has a body 155 having a base 165 with a rib member 164 joined to a head member 164 and head members 166 and 167. The side walls of body 155 are adapted to change in shape, indent and deform due to the application of force when reinforcing bar is moved into grooves 156, 157, 158, 159, 160, 161 and 162. The outer ends of head member 163 and head members 166 and 167 extend into grooves 156 to 162. The outer ends of head member 163 and head members 166 and 167 and the deformation of body 155 prevents the reinforcing bar located in grooves 156 to 162 from moving upward and out of grooves 156 to 162.

Depressions 168 and 169 in the outer ends of top 172 of tie 142 are adapted to accommodate reinforcing cords used in construction of a concrete wall. Projecting members 170 and 171 extending upwardly from top 172 facilitate placement of reinforcing cords in depressions 168 and 169.

Tie 142 has tab members 173 and 174 that extend outwardly from a side 176 of tie 142. Tab members 173 and 174 are adapted to separate ties and preventing warping of ties during shipping.

End portion 124 of web 123 has an inner support 127 and an outer support 128 joined to a truss member 129 which extends between inner support 127 and outer support 128. End portion 126 has an inner support 131 joined to an outer support 132 with a truss member 133 extending between inner support 131 and outer support 132. Outer supports 128 and 132 and truss members 129 and 133 of end portions 124 and 126 are adapted to be located flush with the surfaces of or within foam panels 21 and 22 of insulating concrete form 20 whereby panels 21 and 21 may be laminated, if desired. The outer ends 177, 178, 179 and 181 of ties 142 and 143 are joined to the outer surfaces of inner supports 127 and 131 of end portions 124 and 126 at vertical positions inwardly equidistant from the top and bottom of web 123. Truss members 129 and 133 have a plurality of longitudinal access slots 192 adapted to accommodate a strip member to laterally reinforce insulating concrete form 20.

End portions 124 and 126 have transverse fasteners 182, 183, 184 and 185 extending outwardly from truss members 129 and 133 for securing multiple webs during shipping. Each transverse fasteners 182, 183, 184 and 185 has a pair of bar members 186 and 187 extending transversely from opposite sides of truss members 129 and 133 adjacent the top and bottoms of truss members 129 and 133. Bar members 186 and 187 are spaced laterally from outer supports 128 and 132 whereby the outer edge portions of end portions of adjacent webs can be inserted and retained between bar members 186 and 187 and outer supports 128 and 132 of end portions 124 and 126 to secure the adjacent webs to web 123.

The outer ends of inner supports 127 and 131 have vertical fasteners 188, 189, 190 and 191 adapted to releasably affix end portions 124 and 126 of web 123 to adjacent webs of another insulating concrete form in a reversible manner.

Figure 13:
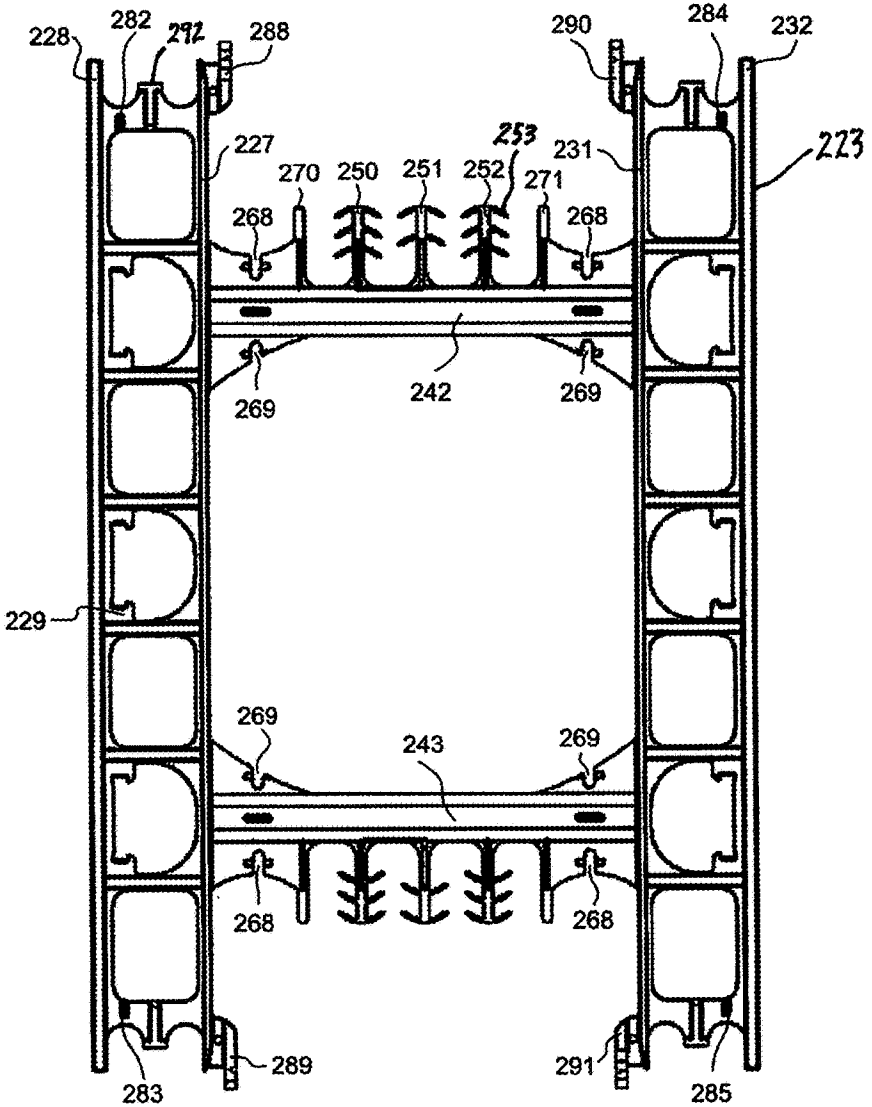
FIG. 13 is a front elevational view of a second modification of the web of the insulating concrete form of FIG. 1.

Referring to FIG. 13, a second modification of a web 223 connecting and holding panels 21 and 22 of insulating concrete form 20 in parallel spaced relation is shown. Web 223 has a pair of ties 242 and 243 extending between inner supports 227 and 231. Ties 242 and 243 have laterally spaced projecting members 250, 251 and 252 forming grooves for receiving reinforcing bar. Projecting members 250, 251 and 252 have arms 253 extending into the grooves adapted to prevent movement of the reinforcing bar out of the grooves. Depressions 268 and 269 in the outer ends of ties 242 and 243 are used to accommodate and hold concrete wall construction reinforcing cords. Projecting members 270 and 271 extending adjacent projecting members 250, 251 and 252 facilitate placement of reinforcing cords in depressions 268 and 269.

The end portions of web 223 have inner supports 227 and 231 joined to truss members 229 extending between inner supports 227 and 231 and outer supports 228 and 232. The upper and lower ends of truss members 229 have vertical supports 292. Outer supports 228 and 232 and truss members 229 are adapted to be located flush with the surfaces or within foam panels 21 and 22 of insulating concrete form 20 allowing for panels 21 and 22 to be laminated, if desired. The end portions of web 223 have fasteners 282, 283, 284 and 285 extending outwardly from truss members 229 for fastening multiple webs during shipping. The outer ends of inner supports 227 and 231 have fasteners 288, 289, 290 and 291 useable to releasably affix the end portions of web 223 to adjacent webs of other insulating concrete forms in a reversible manner.

Figure 14:
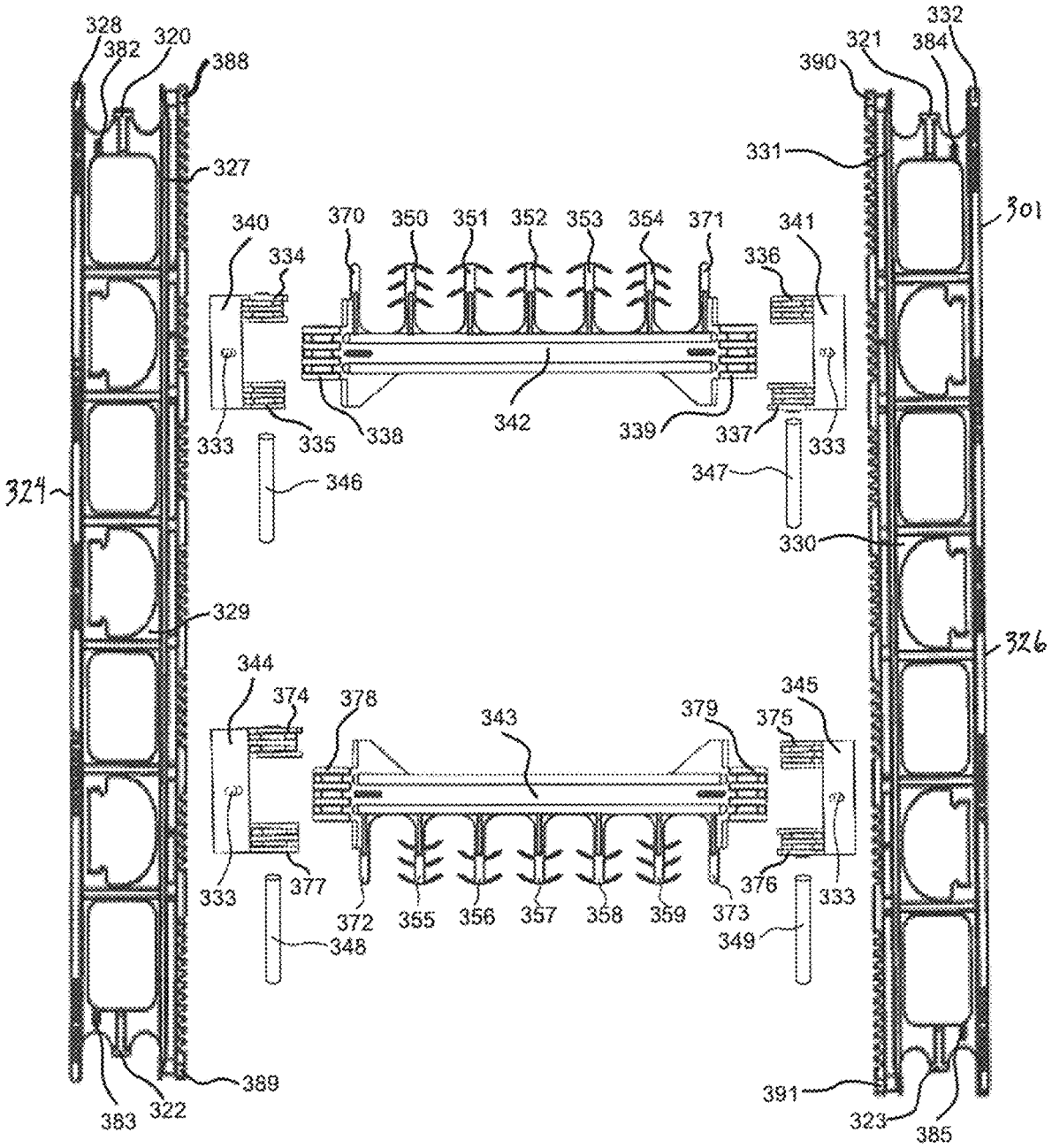
FIG. 14 is an exploded front elevational view of a third modification of the web of the insulating concrete form of FIG. 1.
Figure 15:
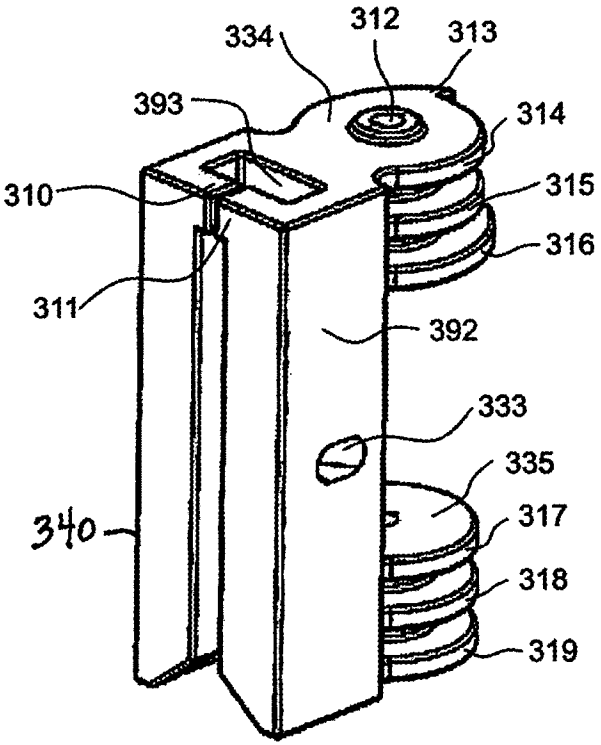
FIG. 15 is an enlarged perspective view of the coupling of the web of FIG. 14.
Figure 16:
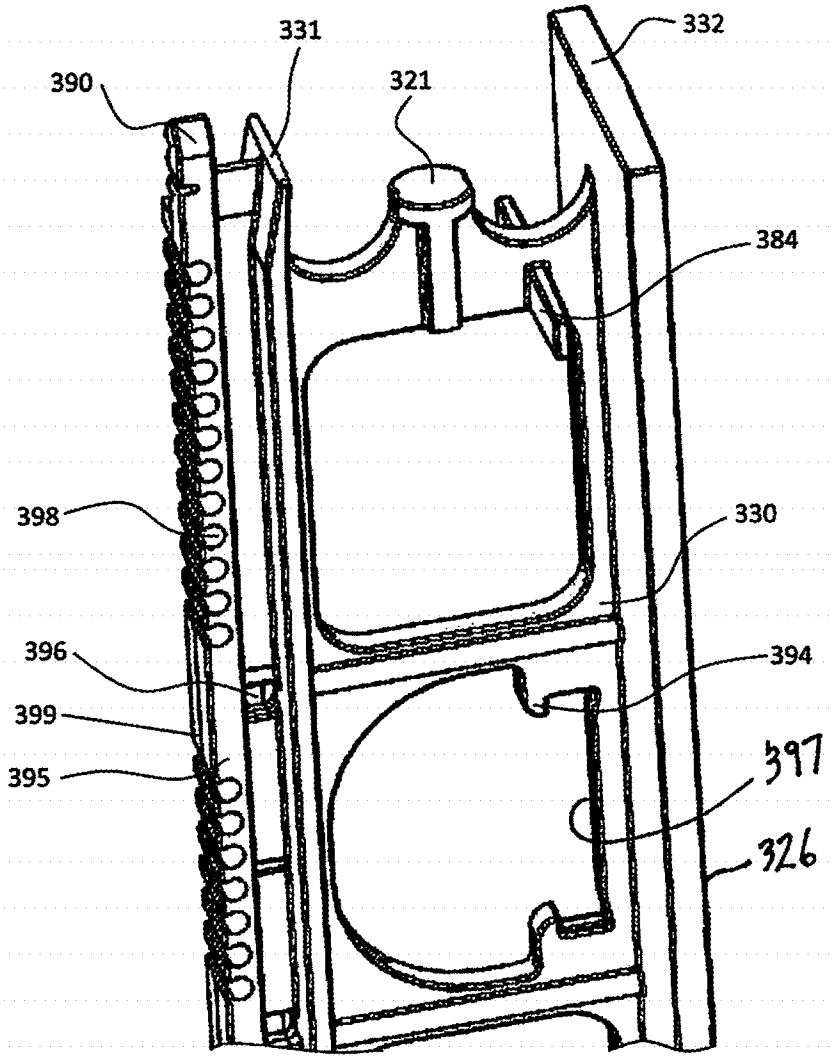
FIG. 16 is an enlarged foreshortened perspective view of an upper portion of the web of FIG. 14.

Referring to FIGS. 14 to 16, a second modification of a web 301 connecting and holding panels 21 and 22 of insulating concrete form 20 in parallel spaced relation is shown. Web 301 has a pair of ties 342 and 343 extending between inner supports 327 and 331. Ties 342 and 343 have laterally spaced projecting members 350, 351, 352, 353, 354, 355, 356, 357, 358, 359, 370, 371, 372 and 373 forming grooves for receiving reinforcing bar. Projecting members 350 to 359 have arms extending into the grooves adapted to prevent movement of the reinforcing bar out of the grooves.

End portions 324 and 326 of web 301 have inner supports 327 and 331 joined to truss members 329 and 330. Truss members 329 and 330 extend between inner supports 327 and 331 and outer supports 328 and 332 of end portions 324 and 326 of web. Outer supports 328 and 332 and truss members 329 and 330 are adapted to be located within or flush with the surfaces of foam panels 21 and 22 of insulating concrete form 20.

End portions 324 and 326 of web 301 have fasteners 382, 383, 384 and 385 extending outwardly from truss members 329 and 330 for fastening multiple webs during shipping. The outer ends of inner supports 327 and 331 have fasteners 388, 389, 390 and 391 for releasably affixing the end portions of web 301 to adjacent webs of other insulating concrete forms in a reversible manner.

The outer ends of ties 342 and 343 have swivel members 338, 339, 378 and 379 connected to end portions 324 and 326 of web 301 with couplings 340, 341, 344 and 345. Pivots 346, 347, 348 and 349 extending through bores 312 in swivel members 334, 335, 336, 337, 374, 374, 376 and 377 of couplings 340, 341, 344 and 345 and swivel members 338, 339, 378 and 379 of ties 342 and 343 pivotally connect ties 342 and 343 to couplings 340, 341, 344 and 345 allowing web 301 to collapse for shipping. Pivots 346, 347, 348 and 349 are held in position within and prevented from inadvertently falling out of bores 312 due to friction of additional material in bores 312 engageable with pivots 346, 347, 348 and 349.

Couplings 340, 341, 344 and 345 are movable along inner connectors 395 on inner supports 327 and 331 to adjust the vertical position of ties 342 and 343 in infinite increments within insulating concrete form 20 to positions ranging from the top of insulating concrete form 20 to the bottom of form 20, as desired. Couplings 340, 341, 344 and 345 are identical in structure and function. The details of coupling 340 shown in FIG. 15 are included in couplings 341, 344 and 345. The following description is directed to coupling 340. Coupling 340 has a channel shaped body 392 having an opening 393 for accommodating inner connector 395 of inner support 327 of end portion 324. Pins 310 and 311 extending into opening 393 register in bores 396 of inner connector 395 to hold coupling 340 at selected vertical positions. Body 392 has a bore 333 adapted to receive a fastener for fastening coupling 340 to inner connector 395 to lock the position of ties 342 and 343 within insulating concrete form 20, if desired. Swivel members 334 and 335 of coupling 340 have ribs 314, 315, 316, 317, 318 and 319 located adjacent bore 312. Ribs 314, 315, 316, 317, 318 and 319 are fluted flange members extending outwardly from the top and bottom portions of body 392. The fluting of body 392 reduces the amount of material required to construct coupling 340 while providing increased strength and durability of coupling 340. Upper rib 314 has an outwardly extending projection 313. Projection 313 is adapted to engage projecting members 370, 371, 372 and 373 to limit pivotal movement of ties 342 and 343 and lock ties 342 and 343 in an open fixed position. Projecting members 370, 371, 372 and 373 are semi-rigid members having the ability to bend and flex out of engagement with projection 313 and spring back to their original shapes and positions. The size of projection 313 and the distance of projection 313 to projecting members 370, 371, 372 and 373 is selected to balance the amount of force required to lock and unlock ties 342 and 343.

As shown in FIG. 16, inner connector 395 has multiple series of vertically spaced indentations 398. Indentations 398 have an inwardly curving shape. Indentations 398 can be made to have other shapes such as a rectangular channel shape. Inner connector 395 has a plurality of vertically spaced faces 399 located between indentations 398 at selected vertical positions to facilitate vertical arrangement of ties 342 and 343 within insulating concrete form 20. Bores 396 extending through inner connector 395 adjacent faces 399 accommodate pins 310 and 311 to hold couplings 340, 341, 344 and 345 at selected vertical positions adjacent faces 399 and lock ties 342 and 343 into measured increments within insulating concrete form 20. Truss members 329 and 330 have a plurality of longitudinal access slots 397 adapted to accommodate concrete reinforcing strip material. Fasteners 394 extend into and form access slots 397 and retain the strip material in access slots 397. The upper and lower ends of truss members 329 and 330 have vertical supports 320, 321, 322 and 322.

Figure 17:
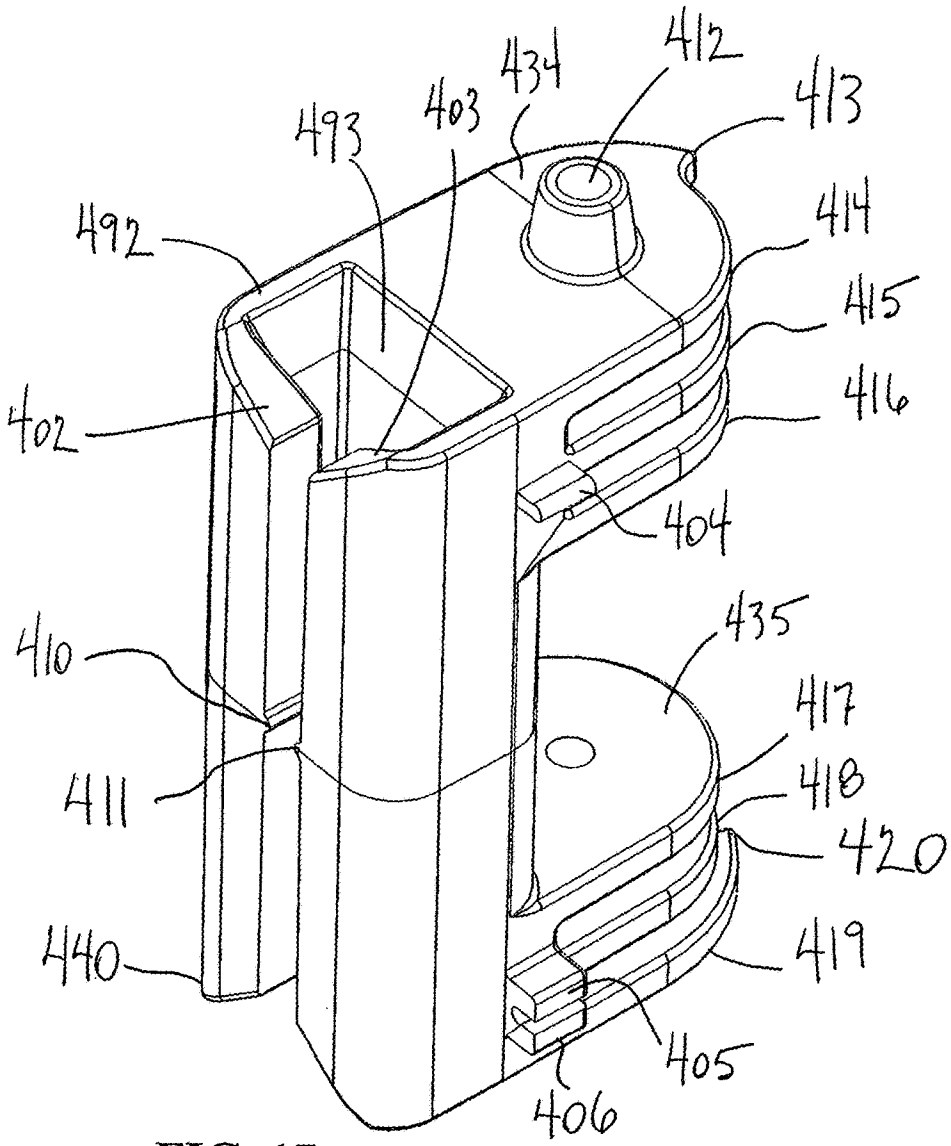
FIG. 17 is an enlarged perspective view of a modification of the coupling of the web of FIG. 14.

Referring to FIG. 17, a modification of a coupling 440 useable to pivotally connect ties 342 and 343 to end portions 342 and 326 of web 301 is shown. Coupling 440 is movable along the length of inner connector 395 on inner supports 327 and 331 of end portions 324 and 326 to adjust the vertical height of ties 342 and 343 in infinite increments within insulating concrete form 20, as desired. Coupling 440 has a channel shaped body 492 having an opening 493 for accommodating inner connector 395. Body 492 has a pair of inwardly directed flanges 402 and 403 extending into opening 493. The outer ends of flanges 402 and 403 have pins 410 and 411 adapted to register in bores 396 in inner connector 395 to hold coupling 440 at selected vertical positions on end portions 324 and 326. Bores 396 extend through inner connector 395 adjacent vertically spaced faces 399 whereby coupling 440 is held at selected vertical positions adjacent faces 399 and ties 342 and 343 are locked into measured increments within insulating concrete form 20. Pins 410 and 411 are centrally located on flanges 402 and 403 whereby the top and bottom portions of coupling 440 are in mirror symmetry and coupling 440 is reversible in assembly and use. Swivel members 434 and 435 of coupling 440 have ribs 414, 415, 416, 417, 418 and 419 surrounding bore 412. Ribs 414, 415, 416, 417, 418 and 419 are fluted flange members extending outwardly from the top and bottom portions of body 492. Pivots 346, 347, 348 and 349 are adapted to extend through bore 412 in swivel members 434 and 435 of connector 440 and swivel members 338, 339, 378 and 379 of ties 342 and 343 to pivotally connect ties 342 and 343 to coupling 440 thereby allowing web 301 to be collapsed for shipping and storage. Pivots 346, 347, 348 and 349 are held in position within bores 412 due to friction of additional material in bores 412 engaging pivots 346, 347, 348 and 349. Upper rib 414 and lower rib 419 have outwardly extending projections 413 and 420. Projections 413 and 420 are engageable with projecting members 370, 371, 372 and 373 to limit pivotal movement of ties 342 and 343. Projecting members 370, 371, 372 and 373 are adapted to bend or flex and be moved out of engagement with projections 413 and 420, if desired, and spring back to their original shapes and positions. The size of projections 413 and 420 and the distance projections 413 and 420 are located from projecting members 370, 371, 372 and 373 is predetermined to balance the force required to lock and unlock ties 342 and 343. Fastening means 404, 405 and 406 extending outwardly from the side of body 492 of connector 440 are useable to releasably affix connector 440 to other connectors for shipping and storage.

Alternatively, ties 342 and 343 may incorporate the features of couplings 340 and 440 in place of separate couplings 340 and 440. Ties 342 and 343 may also include a joint and projections to lock the joint in place.

There has been shown and described several embodiments of the insulating concrete form apparatus of the invention. It is understood that changes and modifications in the insulating concrete forms and webs can be made by persons skilled in the art without departing from the invention which is defined in the following claims.

The invention claimed is:

1. An insulating concrete form apparatus comprising:

a pair of panels with at least one web extending between said pair of panels), each panel of said pair of panels located in spaced relationship to each other, each panel of said pair of panels having a top surface and a bottom surface, each panel of said pair of panels having at least one first protrusion forming part of said top surface, each panel of said pair of panels having at least one second protrusion forming part of said bottom surface, said at least one first protrusion being aligned with said at least one second protrusion such that said pair of panels is adapted to be stacked either above or below additional pairs of panels, said at least one first protrusion being in symmetry with said at least one second protrusion, said at least one web having at least one end portion, said at least one end portion extending along at least one panel of said pair of panels, said at least one web having at least one tie extending to said at least one end portion, said at least one tie being releasably connected to said at least one end portion whereby said at least one tie is adapted to be releasably connected to said at least one end portion along an inner surface of the at least one end portion between a top and bottom elevation of the at least one web, said at least one tie having at least one tie connector, said at least one tie connector having at least one pin releasably connecting said at least one tie to said at least one end portion, said at least one tie connector having a channel shaped body extending over and around the inner surface of the at least one end portion to slideably connect the at least one tie to the at least one end portion, said channel shaped body movable along a length of the at least one end portion to adjust the lateral position of the at least one tie between the pair of panels, said channel shaped body having at least one channel to allow said at least one tie to remain in lateral position relative to said at least one end portion while said channel shaped body is being moved relative to said at least one end portion, said at least one tie having at least one body projecting from the at least one tie, the body adapted to receive a reinforcing bar, the body having a side wall adapted to change in shape and deform when the reinforcing bar is received by the body, said at least one tie having at least one depression, said at least one tie having at least one prong member adapted to receive a strip member.

2. The insulating concrete form apparatus of claim 1 wherein:

said at least one end portion has an inner support and an outer support located in spaced relationship with the inner support, and at least one truss member extending between said inner support and said outer support.

3. The insulating concrete form apparatus of claim 1 wherein:

at least one panel of said pair of panels has at least one indicia oriented to indicate a position of said at least one web within the at least one of said pair of panels, the at least one indicia being rectangular in shape corresponding to the position the at least one end portion of the at least one web.

4. The insulating concrete form apparatus of claim 1 wherein:

said at least one pin is adapted to extend into an indentation in the inner surface of the at least one end portion of the at least one web to releasably connect the at least one tie to the at least one end portion.

5. An insulating concrete form apparatus comprising:

a first panel and a second panel located in spaced relationship relative to the first panel, the first panel and the second panel each having a top surface and a bottom surface, the first panel and the second panel each having at least one first protrusion forming a part of the top surface, the first panel and the second panel each having at least one second protrusion forming a part of the bottom surface, the at least one first protrusion being aligned with the at least one second protrusion such that the first panel and the second panel are adapted to be stacked either above or below additional panels, the at least one first protrusion being in symmetry with the at least one second protrusion, at least one web extending between the first panel and the second panel, the at least one web having at least one end portion, the at least one end portion extending along at least one of the first panel and the second panel, the at least one web having at least one tie extending to the at least one end portion, the at least one tie being releasably connected to the at least one end portion whereby the at least one tie is adapted to be vertically moved and releasably connected to the at least one end portion along an inner surface of the at least one end portion between a top elevation and a bottom elevation of the at least one web, the at least one tie having at least one tie connector, said at least one tie connector having a channel shaped body extending over and around the inner surface of the at least one end portion to slideably connect the at least one tie to the at least one end portion, said channel shaped body movable along the at least one end portion to adjust the lateral position of the at least one tie between the first panel and the second panel, the at least one tie connector releasably connecting the at least one tie to the at least one end portion thereby allowing the at least one tie connector to be moved along the at least one end portion, the at least one tie having at least one body projecting from the at least one tie, the body adapted to receive a reinforcing bar, the body having a side wall adapted to change in shape and deform when the reinforcing bar is received by the body, and at least one of the first panel and the second panel having at least one indicia oriented to indicate a position of the at least one web within the first panel and the second panel.

6. The insulating concrete form apparatus of claim 5 wherein:

the channel shaped body has at least one channel member accommodating the at least one end portion adapted to allow the at least one tie to remain in a lateral position relative to the at least one end portion while the channel shaped body is being moved relative to the at least one end portion.

7. The insulating concrete form apparatus of claim 5 wherein:

the at least one tie connector has at least one pin releasably connecting the at least one tie to the at least one end portion.

8. The insulating concrete form apparatus of claim 5 wherein:

the at least one end portion has an inner support and an outer support located in a spaced relationship relative to the inner support, and at least one truss member extending between the inner support and the outer support.

9. The insulating concrete form apparatus of claim 5 wherein:

the at least one tie has at least one depression.

10. The insulating concrete form apparatus of claim 5 wherein:

the at least one tie has at least one prong member adapted to receive a strip member.

11. An insulating concrete form apparatus comprising:

a first panel and a second panel located in spaced relationship relative to the first panel, the first panel and the second panel each having a top surface and a bottom surface, the first panel and the second panel each having first protrusions forming a part of the top surface, the first panel and the second panel each having second protrusions forming a part of the bottom surface, the first protrusions being aligned with the second protrusions such that the first panel and the second panel are adapted to be stacked above or below additional panels, the first protrusions being in symmetry with the second protrusions, a web extending between the first panel and the second panel, the web having a first end portion and a second end portion opposite the first end portion, the web having a tie extending between the first end portion and the second end portion, the tie being releasably connected to the first end portion and the second end portion whereby the tie is movable along the first end portion and the second end portion to selected positions within the first panel and the second panel, the tie having a first tie connector attached to the first end portion and a second tie connector attached to the second end portion, the first tie connector having a first channel shaped body extending over and around the first end portion to slideably connect the tie to the first end portion, the second tie connector having a second channel shaped body extending over and around the second end portion to slideably connect the tie to the second end portion, the first channel shaped body movable along the first end portion and the second channel shaped body movable along the second end portion to adjust the lateral position of the tie between the first panel and the second panel, the first panel and the second panel each having indicia oriented to indicate a position of the web within the first panel and the second panel, the indicia having a shape and an orientation indicating a size of each of the first end portion and the second end portion and a relative position of each of the first end portion and the second end portion of the web.

12. The insulating concrete form apparatus of claim 11 wherein:

the first tie connector and the second tie connector are movable in tandem along the first end portion and the second end portion.

13. The insulating concrete form apparatus of claim 11 wherein:

the first channel shaped body and the second channel shaped body allow the tie to remain in a lateral position relative to the first end portion and the second end portion while the first channel shaped body and the second channel shaped body are being moved relative to the first end portion and the second end portion.

14. The insulating concrete form apparatus of claim 11 wherein:

the first tie connector and the second tie connector each have a catch member releasably connecting the tie to the first end portion and the second end portion.

15. The insulating concrete form apparatus of claim 11 wherein:

the first end portion and the second end portion each have an inner support and an outer support located in a spaced relationship relative to the inner support.

16. The insulating concrete form apparatus of claim 11 wherein:

the tie has a prong member adapted to receive a strip member.

* * * * *